US006461250B1

(12) United States Patent
Klyve

(10) Patent No.: US 6,461,250 B1
(45) Date of Patent: Oct. 8, 2002

(54) BAND PUTTER

(75) Inventor: Jon Klyve, Bergen (NO)

(73) Assignee: Clyve AS, Bergen (NO)

( * ) Notice: Subject to any disclaimer, the term of this patent is extended or adjusted under 35 U.S.C. 154(b) by 0 days.

(21) Appl. No.: 09/932,920

(22) Filed: Aug. 21, 2001

(30) Foreign Application Priority Data

Mar. 29, 2001 (NO) ..... 011618

(51) Int. Cl.[7] ..... A63B 53/04
(52) U.S. Cl. ..... 473/329; 473/340
(58) Field of Search ..... 473/324, 329, 473/340, 342, 350, 349, 238, 251, 226, 219, 231, 225, 242, 288, 236, 345

(56) References Cited

U.S. PATENT DOCUMENTS

| | | | | |
|---|---|---|---|---|
| 777,400 | A | * | 12/1904 | Clark |
| 890,836 | A | * | 6/1908 | Beale |
| 2,111,249 | A | * | 3/1938 | Plese |
| 4,113,249 | A | * | 9/1978 | Beery |
| 4,422,638 | A | * | 12/1983 | Tucker |
| 5,190,290 | A | * | 3/1993 | Take |
| 5,316,304 | A | * | 5/1994 | Yost |
| 5,332,214 | A | * | 7/1994 | Tucker |
| 5,464,212 | A | * | 11/1995 | Cook |
| 5,501,453 | A | * | 3/1996 | Hurst |
| 5,643,109 | A | * | 7/1997 | Rose |
| 5,899,819 | A | * | 5/1999 | Mount |

FOREIGN PATENT DOCUMENTS

| | | | |
|---|---|---|---|
| GB | 879553 | * | 10/1961 |
| WO | WO 00/27483 | * | 5/2000 |

* cited by examiner

*Primary Examiner*—Sebastiano Passaniti
(74) *Attorney, Agent, or Firm*—Rothwell, Figg, Ernst & Manbeck

(57) ABSTRACT

The invention relates to an interchangeable part of a golf putter, as well as the golf putter head comprising the interchangeable part. The interchangeable part including the putter striking surface being constituted by a band shaped material being mounted on a tension bar providing a chosen and prefixed tension to the band material at the striking surface.

The band-shaped material constitutes a loop and the tension bar is provided at least partially inside the band shaped material thus being adapted to apply a tension to the band, the tension bar also includes protrusions on each side of the striking surface thus defining a recess behind the band at the striking surface, and the putter head comprises holding means for receiving the stretched band and tension bar and locking them into position in the putter head.

18 Claims, 8 Drawing Sheets

BAND PUTTER

BACKGROUND OF THE INVENTION

1. Field of the Invention

This invention relates to a golf putter head comprising an interchangeable part such as a cassette including the putter striking surface being constituted by a band shaped material being mounted on a tension bar providing a chosen tension to the band material at the striking surface.

2. Description of the Related Art

When using a putter (to put a golf ball) on a putting green, the golfer strikes the ball applying a roll-spin to the ball as soon as possible after stroke of putter in order to move the golf ball along a desired (and a more predictable) path and length. When a golf ball is to be putted into the intended hole it is important that the ball follow an expected-desired path and length. The conformity between expected and actual length and path of a put is vital. In this connection, the aim is normally to give the ball an even rolling movement over the surface, i.e. with rolling contact with the grass on the green, and preferably without causing the ball to jump unintentionally in initial phase after impact of the putter on the grass.

According to this invention, the aim is to give the golf ball an intentional roll as soon as the stroke is played. It is also important to transfer as much as possible of the kinetic energy from putter to the ball to obtain a more predictable length of ball roll.

In other words, it is desirable—at least with certain putting strokes—to transfer a large part of the kinetic energy from the golf club to the golf ball thereby causing the ball to take on a rolling movement, i.e. instead of applying a non-rolling stroke to the ball, a stroke is played which gives the ball a combined thrust and rolling movement. Using conventional golf clubs the golf ball is given an intentional roll of this kind by, for example, by holding the strike area of the putter at an appropriately oblique angle.

Alternatively, the putter can "top" the golf ball by striking it at a level above its the horizontal mid-plane. The strike area of the putter normally has a vertical position when the putter is in a normal vertical position in connection with a putting stroke. But by having the strike area at an oblique angle in relation to the vertical plane one may deliberately seek to create great friction between the golf ball and the grass of the green already in the very first phase of the ball's rolling movement as a result of the obliquely angled stroke played against the golf ball. The better less energy loss in energy transition from putter to movement of the ball, will give a more and better prediction both in length and path of the ball in relation to aim/hole.

Consequently, the aim is to apply as controlled a roll as possible to the golf ball at an early stage in the movement of the golf ball. In practice, however, in many cases the point at which the roll starts after the stroke has been played is a matter of chance, and also the degree of roll, since after being struck by the golf club the golf ball, in certain cases, may be given a rapid upward lifting movement from the underlying surface and may therefore make a subsequent soaring movement in relation to the underlying surface. Thus, the golf ball is given a limited or more or less uncontrollable roll. Until now, the position of the strike area of the putter in relation to the golf ball has been very decisive for the movement of the golf ball in relation to the underlying surface. However, local conditions (humidity/dampness, unevenness etc.) on the green affect, to a varying degree, the friction of the golf ball and thereby its speed of movement and pattern of movement, including the roll movement and the speed of the roll. When the player's putter stroke meets the golf ball in an area above the horizontal mid-plane of the ball, the golf ball may experience an element of downward force in the direction of the grass on the green, with the result that one achieves intentionally greater friction and an intentional roll on the golf ball at an early stage of the stroke, thereby allowing the ball to roll in an intentional spinning plane and obtaining the gyro effect.

Further, when the player places the strike area of the putter at an oblique angle upwards and forward, it is possible, by applying this intentional initial friction against the grass, to ensure that a controlled pattern of movement of the golf ball is achieved in more or less continuous contact with the grass during the rolling movement.

On the other hand, if, for example, the player places the strike area of the putter at an oblique angle upwards and backward, it is possible to give the golf ball an intentional soaring or jumping movement, in cases where this is desired. Using this invention, the aim is to arrive at a solution whereby the putter can give the golf ball a relatively soft and sensitive stroke whereby the gyro effect is obtained as soon as possible after impact and more of the force from the putter is transmitted to the ball at an early stage after the stroke. This give a more predictable length of roll and direction of the the balls movement. The level of power transferred is adjustable and where the putter, in this connection, can easily give the golf ball the exactly desired movement by giving it the intended roll and the desired gyro effect. The aim is to ensure that the intended roll movement of the golf ball can be effected directly from the strike area of the putter, i.e. at an early stage in the 1. stroke of the putter against the actual golf ball and with easy and sensitive control of the stroke and to overcome the inertia force of the ball.

International patent application No. PCT/NO99/00314 describes a golf club in which this problem is solved by arranging the strike area of the putter in such a way that an interchangeable/replaceable longitudinal, lengthwise extended tension bar is attached to two fastening points at each end of the putter head through the two opposite ends of the tension bar, and with the lengthwise tension bar, attached through the two opposite ends, stretching freely over a hollow in the putter head. Using the lengthwise extended tension bar, which extends freely over a hollow in the putter head, it is possible to achieve some softening of the putter stroke against the golf ball and at the same time have the possibility of giving an initial roll to the golf ball immediately on striking the ball.

This solution is, however, complicated and is not easily adjusted to specified tensions in the band. If the band is stretched it may lose its tension, depending on the material used, and it is impossible to apply further tension later. Also, in the above mentioned application the size and shape of the striking area is fixed, as the hollow behind the band at the striking area is defined by the opposite ends of the tension bar. Also, it is not possible to have the putter accepted for use in competitions as the striking surface will be too flexible.

U.S. Pat. No. 5,643,109 describes a putter head having a striking surface being constituted by a band loop and being adjustable in the back using a screw mechanism. The band material is not mentioned but it is said to be flexible and is probably a fibre material or similar. The putter head also comprises a recess behind the band and the putter head.

The solution according to U.S. Pat. No. 5,643,109 in which the striking surface is flexible and not hard and rigid, as demanded by the golf rules according to R&A and USGA. Also, the solution does not conform with the rules of golf in being adjustable during use.

It is therefore an object of this invention to provide a golf putter head which may be allowable according to the rules of golf having an improved replaceable striking surface as a cassette prefixed tensile tension in the band, varies from cassette to cassette, consituted by a tension band, the tension of said band being within a wide range, depending on the whishes of the player.

It is an additional object of this invention to provide a golf putter head in which the shape and size of the flexible part of the striking surface may be chosen with a wide range of shapes and tension in the band.

It is also an object of this invention to provide an interchangeable part, or cassette, comprising a replaceable part adapted to the abovementioned golf club.

It is another object of this invention to provide an interchangeable part being inexpesive to produce.

An interchangeable part for use in golf clubs is described in U.S. Pat. No. 5,190,290. This, however, represents a completely different solution being related to golf clubs, and not putters and being based on different types of synthetic materials being positioned in the back of the cassette to provide a softer and more flexible feel.

U.S. Pat. No. 4,422,638 and GB 2,281,041 describe interchangeable parts in a golf putter in which the interchangeable striking surfaces are made from a rubber material. This solution results in larger friction between the ball and the striking surface and loss of energy in the strike thus providing a non-optimal solution.

SUMMARY OF THE INVENTION

The objects of this invention are obtained by providing a golf putter and an interchangeable cassette for a golf putter as described above, and being characterized in that the band-shaped material constitutes a loop and the tension bar is provided at least partially inside the band shaped material thus being adapted to apply a tension to the band, the tension bar also being including protrusions on each side of the striking surface thus defining a hollow or recess behind the band at the striking surface, and that the putter head comprises holding means for receiving the stretched band and tension bar and locking them into position in the putter head.

According to the invention, by ensuring that the said tension bar is locally pliable it is possible to achieve a relatively extensive, i.e. a relatively wide strike area between the putter head and the golf ball. By giving the said tension bar a relatively smooth and low-friction strike surface it is possible to ensure that there is low friction between the putter head and the golf ball in order to deliberately cause the golf ball to have the intended rolling movement. This can also be further controlled, for example by raising or lowering the putter head in relation to the centre of gravity of the ball. A delayed transfer of the force (kinetic energy) from the putter head to the ball will give a smoother and softer stroke. This greatly affects the ball and causes the ball to roll soon after the stroke. The roll is desirable immediately after the stroke in order to obtain the gyro effect, which in turn gives better stability both in direction and length.

Also according to the invention is an interchangeable cassette in which the parts may be produced using extruding profiles which are cut in chosen sizes, and the band may similarly be mass produced as thin tubes which also may be cut into the chosen dimension, thus providing a cost efficient production method.

DESCRIPTION OF THE DRAWINGS

Other features of this invention are shown in the following description with reference to the accompanying drawings, as follows.

DETAILED DESCRIPTION OF THE INVENTION

Figure 1:
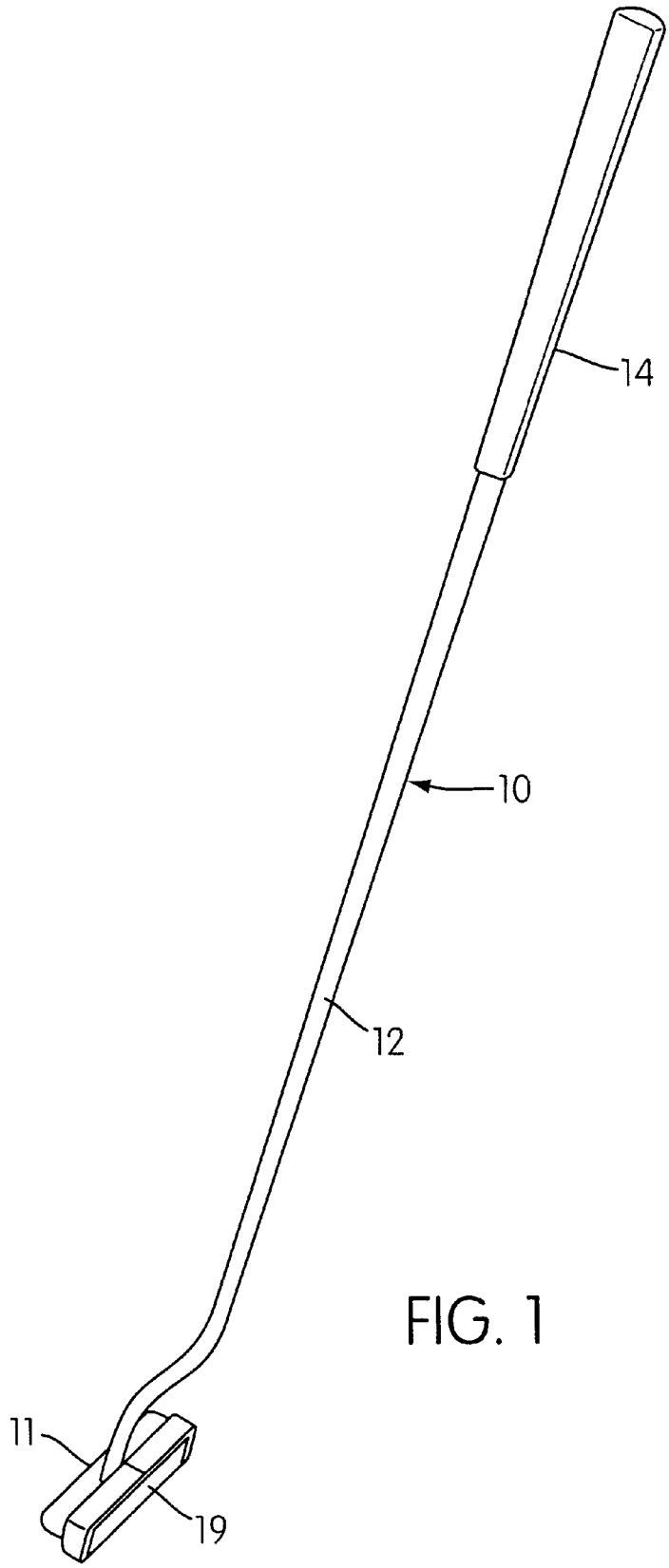
FIG. 1 is a drawing of a golf club of the putter type, as 10 seen facing the strike area of the club head.

FIG. 1 shows a golf club 10 of the putter type, consisting of a club head 11, connected to a shaft section 12. The shaft section 12 is shown with a traditional hand grip 14 to be included: long shaft, lefthand. This particular case relates to a putter with a putter head which can be adjusted in different ways relatively simply. In accordance with the adjustment requirements laid down by the "Royal and Ancient Golf Club of St. Andrews" and the "United States Golf Association", the weight of other golf clubs than putters may be adjusted. However, as regards putters, other adjustments may be made in accordance with the following:

(I) It must not be possible to make the adjustment easily.

(II) All adjustable parts shall be fixed firmly in place during use so that there is no reasonable possibility of parts loosening or of them actually being re-adjusted during use/play.

(III) All results of adjustments made must be in accordance with stipulated rules.

(IV) Striking area shall be hard and rigid. No visible movement to be observed in the striking area, when pressing at striking area by manual force.

The conclusion is that the functional properties of a golf club (in this connection also including a putter) cannot be changed during play and that any change during play will entail the disqualification of the player from the game in play.

According to the invention, the golf club (the putter) is described and shown taking account of the permitted adjustments, as mentioned above. In other words, according to the invention, the different versions and the different alternative parts provide the possibility of making a number of different adjustments, including the interchange/replacement of different parts and some adjustment of the parts in relation to each other. It is envisaged that adjustments of this kind will be made in a workshop, or using special tools, thereby—as intended—making it difficult to adjust the putter during use/play. The actual club head 11, in accordance with the version shown, can be made of light metal, such as an aluminium alloy, while the interchangeable/replaceable part in the club head which is the actual strike area may be made of another material.

Figure 2A:
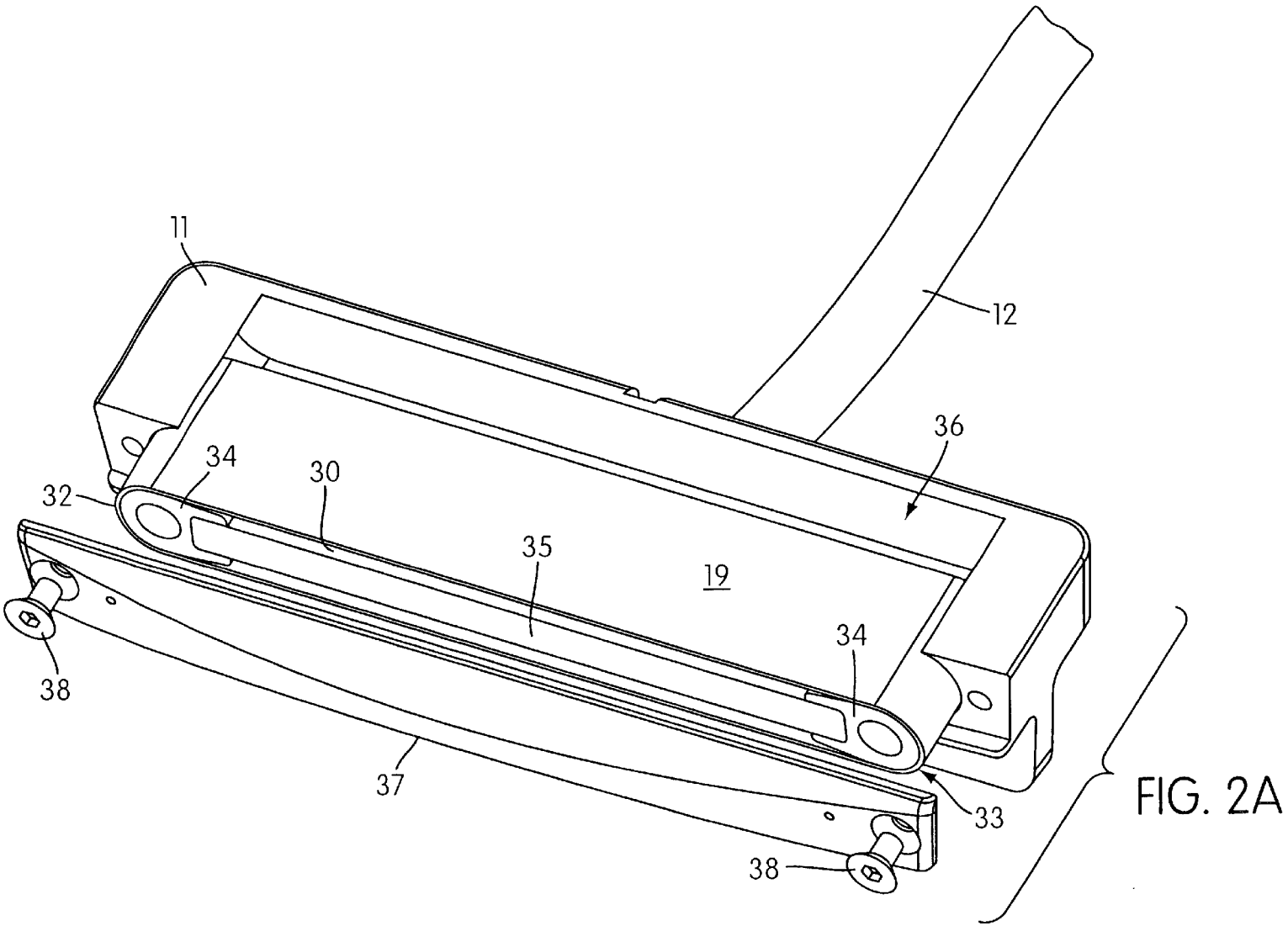
FIG. 2A is a partially exploded drawing showing the different parts of a putter head according to the invention.
Figure 2B:
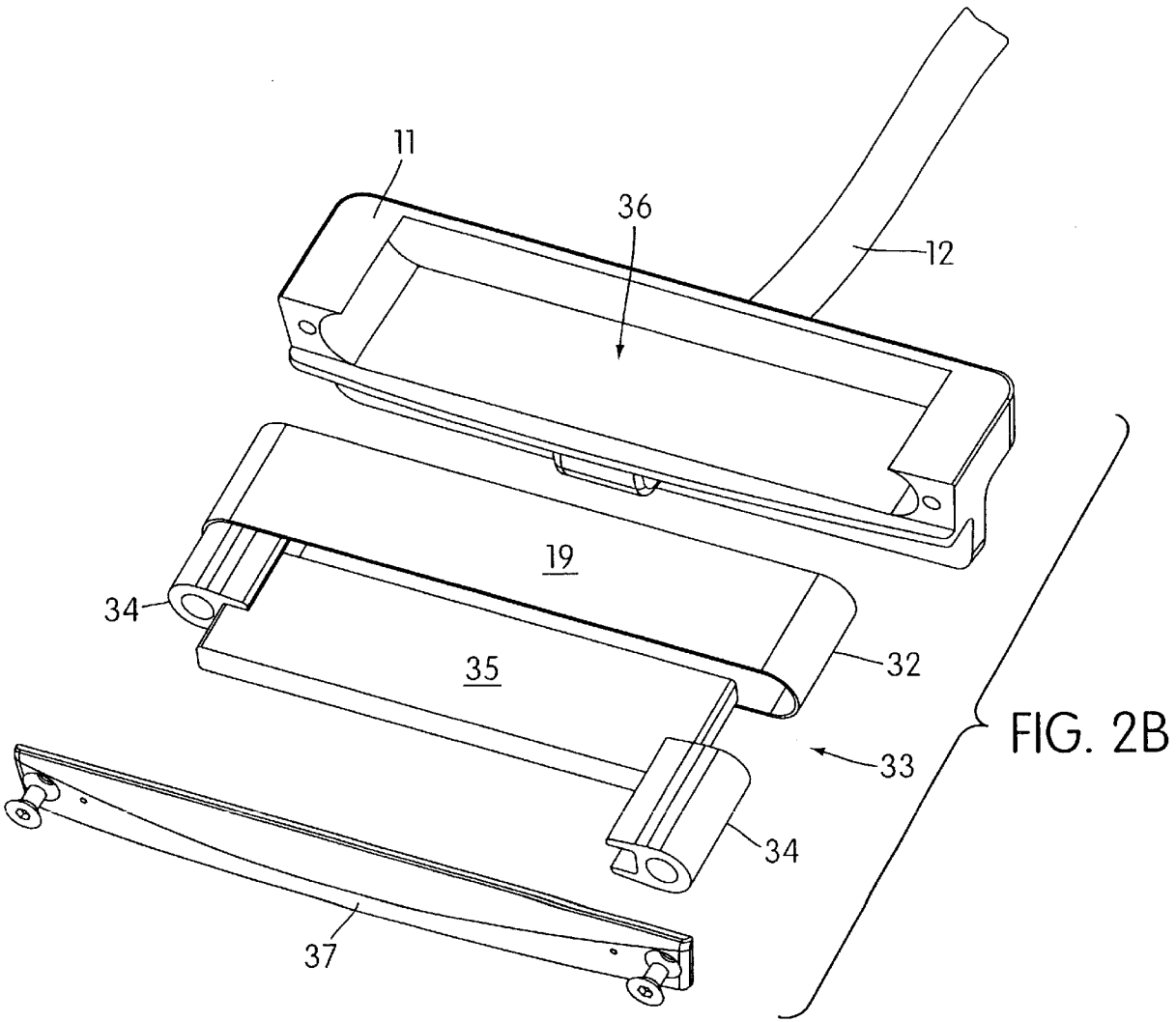
FIG. 2B is an exploded drawing showing the different parts of a putter head according to the invention.
Figure 3:
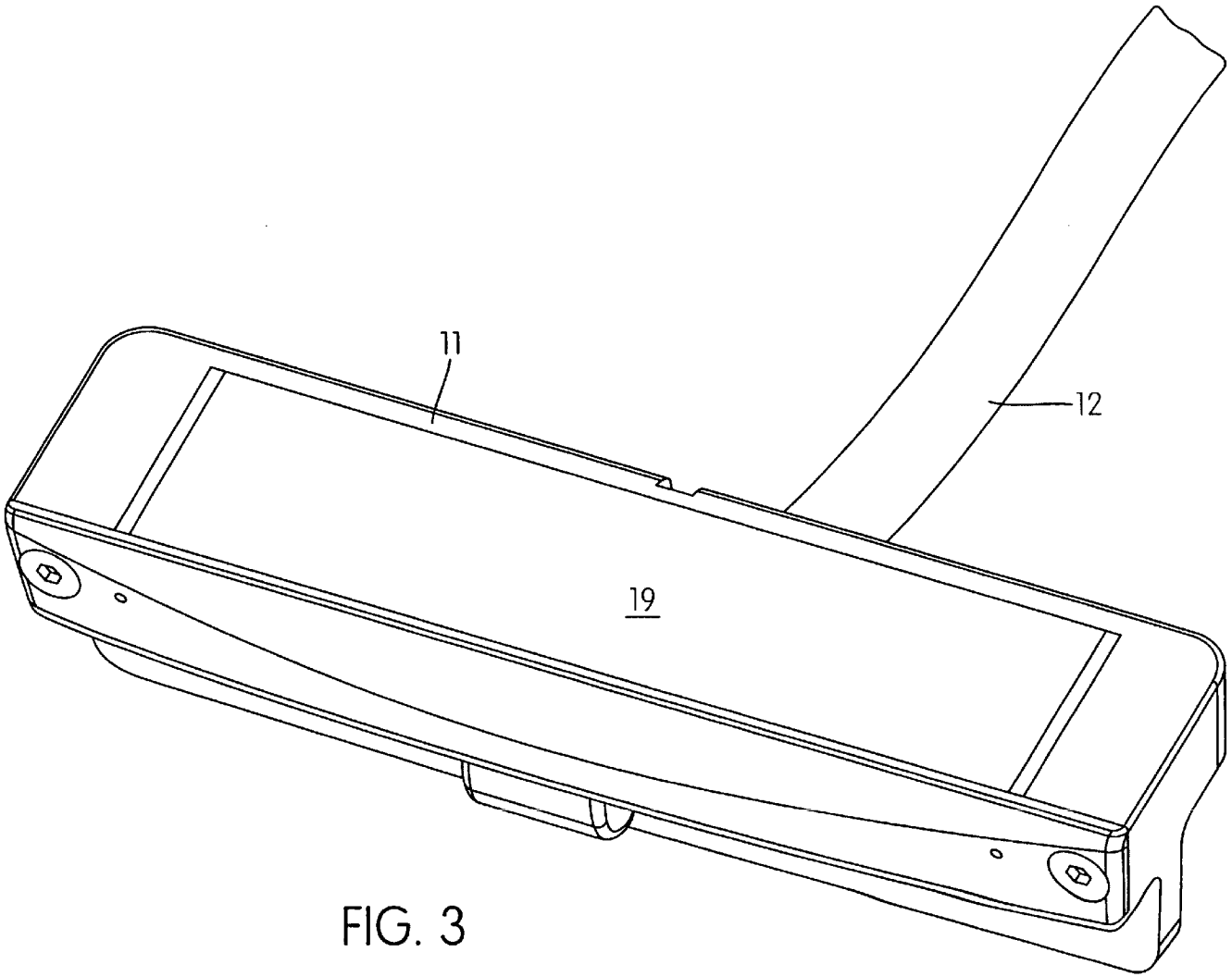
FIG. 3 is a view of the embodiment shown in FIG. 2A and 2B being assembled.

The club head 11 in the version shown in FIGS. 2A and 2B has a stiff and stable part made of steel or light metal and with a curved or relatively flat bottom part 37. The putter bead defines milled or cast space 36 for the interchangeable part, or cassette, 33.

The interchangeable part 33 comprises a tension bar 34,35 in the drawing including a flat locking plate 35 and two end pieces 34, both of which are positioned inside the loop shaped band material 32 constituting the striking surface.

Figure 4B:
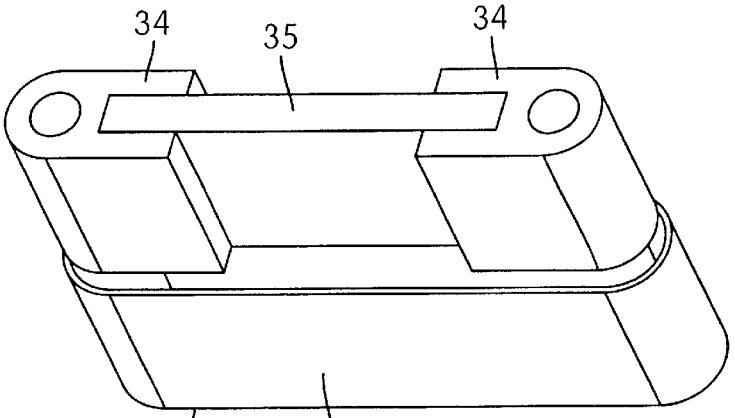
FIGS. 4A–G illustrates different embodiments of the interchangeable cassette of the invention.
Figure 4D:
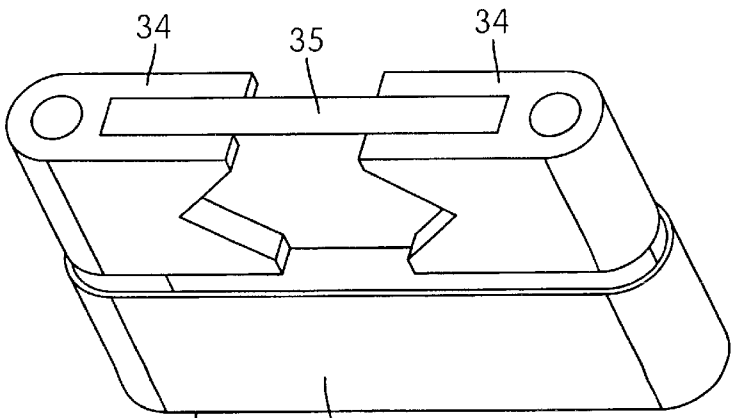

The tension bar 34,35 comprises protrusions extending toward the striking surface thus providing a recess 30 behind the band in the striking area 19. Thus a slightly flexible striking area is obtained. The tension bar is fitted into the milled space 36 being adapted to keep it firmly in place during use. Connection between the front band with striking surfaces and the back band may be effected by pins 39 or similar protrusions through the tension bar 35, as shown in FIGS. 4F and 4G.

The physical dimensions of the end pieces 34 and the locking plate 35 are adapted to provide a prefixed tensile tension on the band when being positioned within the loop. The tension may be adjusted by exchanging the cassette-interchangeable part, the locking plate 35 or the end pieces 34, or as an alternative embodiment, the length of the tension bar may be adjustable in a per se known way not being essential to this invention.

The end/bottom plate 37 of the putter head locks the interchangeable part 33 into place using locking screws 38. Thus the band tension is not easily adjusted or the interchangeable part exchanged during use.

According to the invention, with the version shown, the aim is to devise an especially simple, barely concealed, and relatively uncomplicated club head construction and a relatively simple interchangeable/replaceable part cassette which is firmly attached to the club head construction. The cassette is attached to the club head 11 preferably with an exactly measured, permanent band loop tensile force. The tensile strength may be determined using a tension device, details of which are not essential to the invention and thus not described here.

The band material may itself consist preferably of metal, e.g. steel, but may also consist of a fibre material with a high tensile strength in the form of a band. In the latter case a certain elasticity may be achieved in the weaving, for example locally in the weaving, and more specifically, locally in the actual strike area 19 of the tension bar 34,35. Typically the thickness of the band material may be in the range of 0.5–1.0 mm, depending on the material. It is, however, important that the combined thickness and tension should provide a band which is not noticably moved when subject to an applied manual force. To provide a differentiated flexibility over the striking surface the band may have a varying thickness.

An important aspect of the invention is that the band material should have low friction relative to the golf ball. This may be obtained using a coating, e.g. teflon®- or grafite-coatings.

Alternatively, the band 32 may be made of metal or other suitable material with a high tensile strength, such as a composite material with certain tension-absorbing components and other more elastic components. Using a metal band it is possible to achieve the desired low degree of friction by polishing or coating the band/striking area with low friction material-coating, and thereby the desired effective friction effect between the surface of strike area 19 and the golf ball to obtain an earlier roll of ball after impact/stroke of putter.

The remaining parts of the putter head are preferably made from metal, the putter head 11, the bottom plate 37 and the end pieces 34 from steel or titanium and the locking plate 35 from titanium or other metals or materials.

FIGS. 4A–4G illustrates different embodiments of the interchangeable part according to the invention.

Figure 4A:
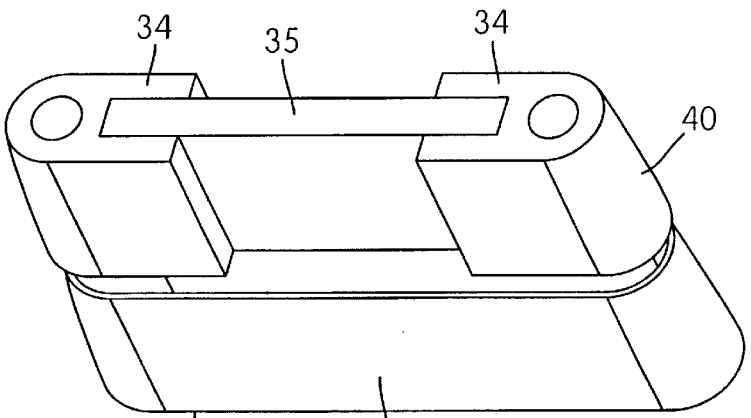

In FIG. 4A the outer ends 40 of the end pieces 34 are wedge shaped in the vertical direction, thus forcing a larger tension on the lower end of the striking surface 19 then the upper end, an uneven tensile tension in section of the band 31 providing a possibility to adjust the tension of the striking surface hitting the ball by adjusting the height of the golf putter relative to the ball.

FIG. 4B provides a simple, rectangular striking surface 19 with an even tensile tension distribution in the band 32.

Figure 4C:
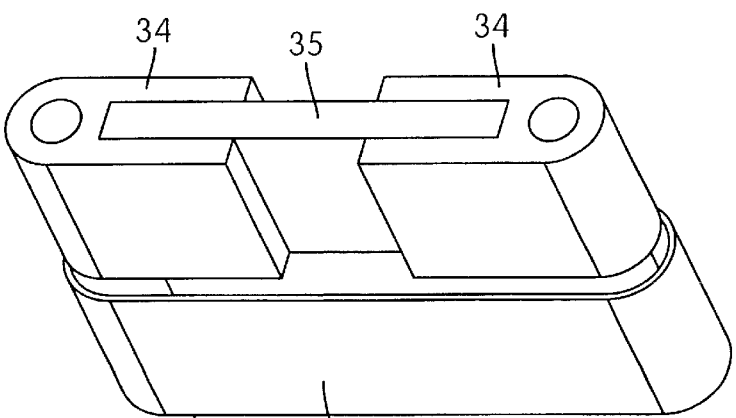
Figure 4F:
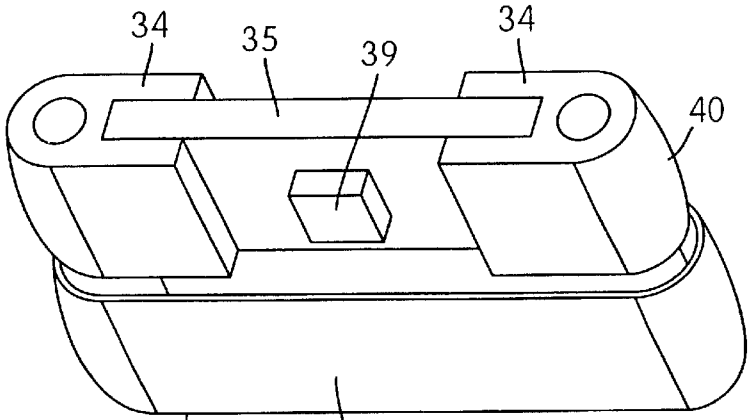

FIG. 4C provides a small flexible striking area 19 and a larger solid area in which the golf ball hits the end pieces 34 directly through the band 32.

FIG. 4D shows an embodiment providing an alternative shape of the striking area by altering the shape of the parts of the end pieces 34 extending toward the middle of the locking plate 35. As the tension of the band 32 is evenly distributed, but the length of the flexing area changes the flexibility of the band is largest in the middle of the striking area 19.

Figure 4E:
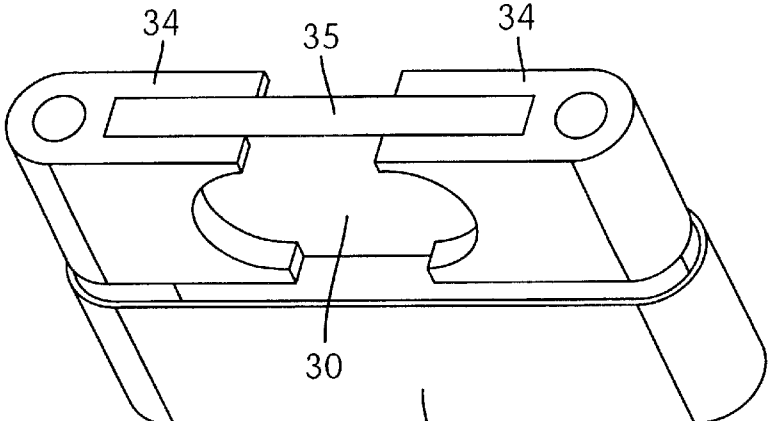
Figure 4G:
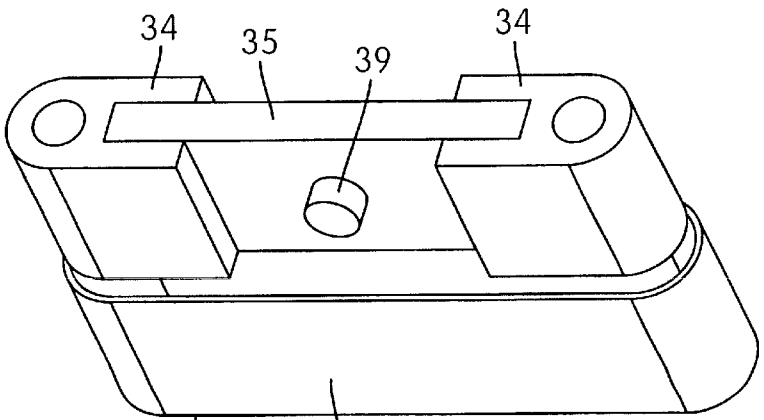

FIG. 4E illustrates a similar situation as FIG. 4D, providing an oval recess 30 behind the striking area 19.

In FIG. 4F the tension bar includes an additional protrusion 39 shaped as a pin extending toward the band 32 in the striking area. This solution provides a possibility for altering the flexibility of the striking area locally, providing special features when striking the golf ball. The pins 39 may be made from metal or another suitable material depending on the wishes of the user. The same relates to the positions and shapes of the additional protrusions 39, as well as the length with which they extend toward the band.

In a preferred embodiment the pin 39 extends through the tension bar or locking plate 35, toward the band back, thus also providing a possibility for a controlled movement using the flexibility of the band at the back as a counterforce when exceeding a chosen force. The gap between the pin and the band, at both sides of the interchangeable cassette, may be chosen according to the force with which the band should be subject to before the pin and the back part of band goes into action. Typically thee size of the gap may be less than one mm preferably in the range from 1/500 mm to 7/10 mm.

The drawing shows one pin, but in some cases a number of pins distributed over the surface may be provided.

Figure 5A:
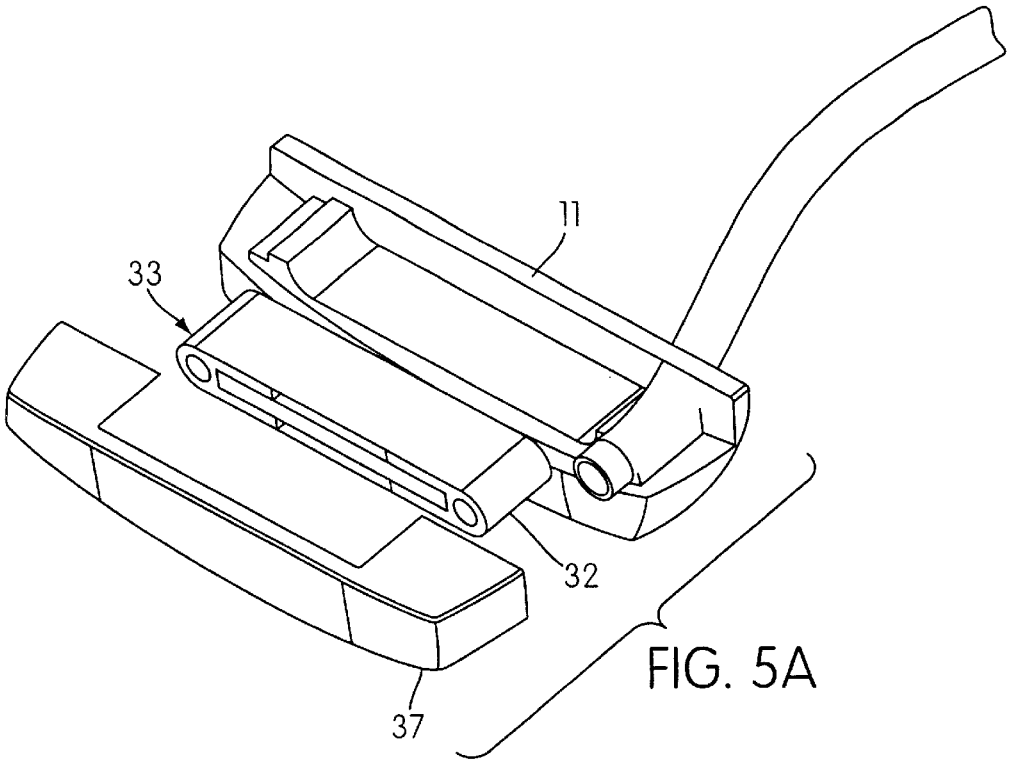
FIGS. 5A–B illustrates two alternative embodiments of the golf putter head according to the invention.
Figure 5B:
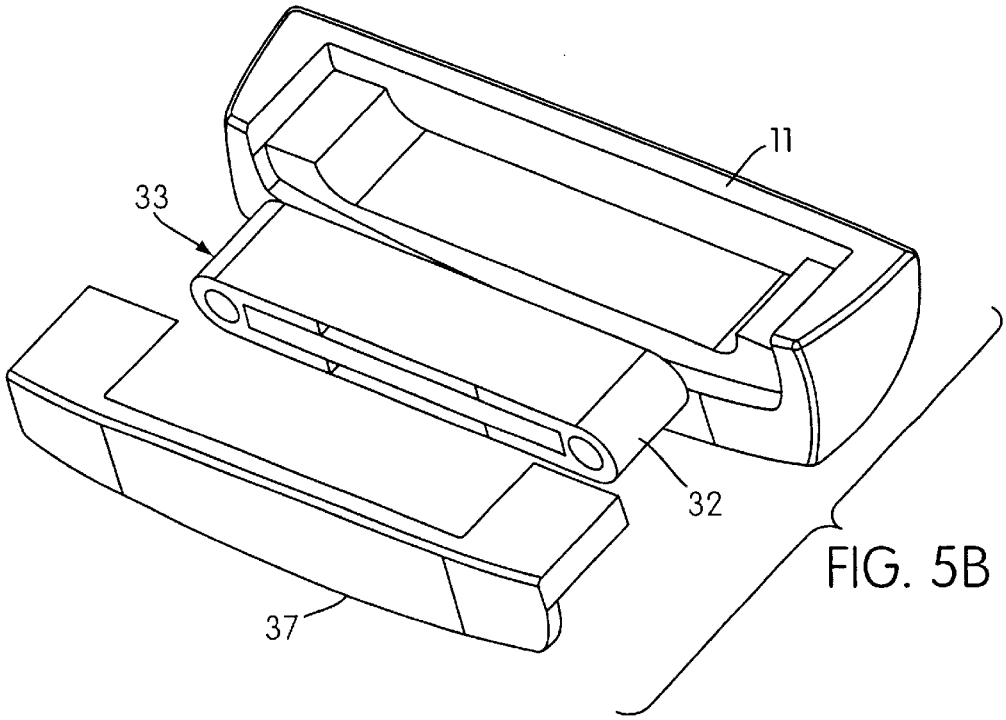

Any combinations of the shown embodiments are also within the scope of this invention, as defined by the accompanying claims. FIGS. 5A and 5B illustrate two alternative embodiments of the club head according to the invention in which the interchangeable cassette may be inserted. Preferably the dimensions should be chosen so as to accept interchangeable part having varying dimensions, e.g. by clamping the cassette position when locked together.

Figure 6:
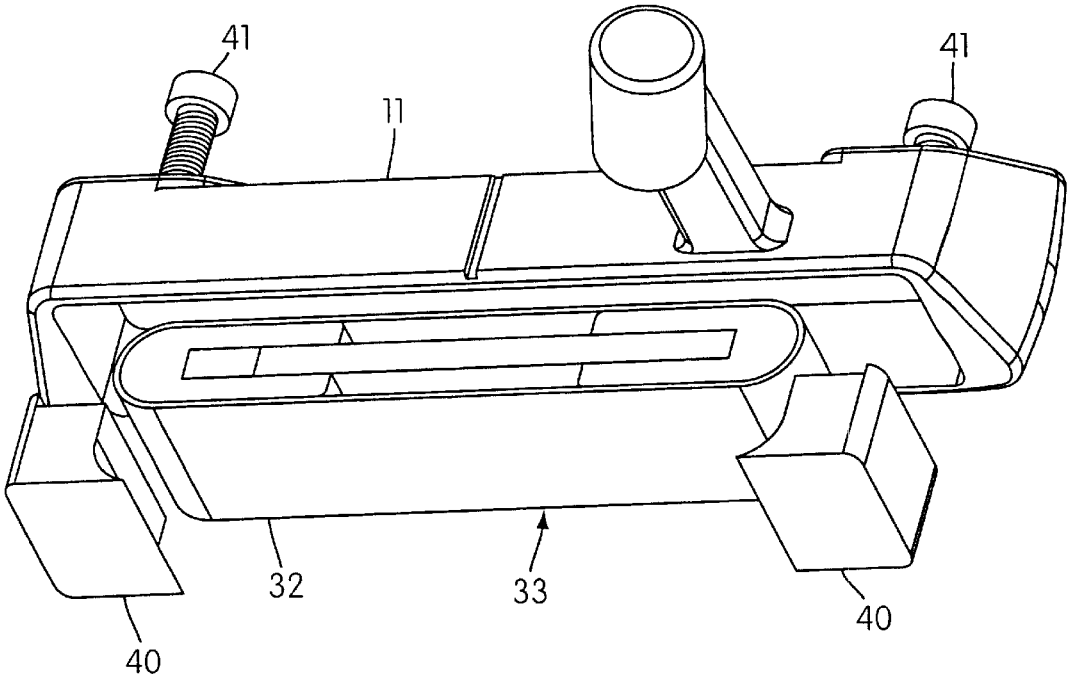
FIG. 6 illustrates another embodiment of the gulf putter head according to the invention.

FIG. 6 shows another alternative in which the cassette 33 is positioned in through the front of the putter head 11 and is held in position using clamps 40 fastened to the putter head by screws 41 from the back of the putter.

As indicated above the end pieces 34 and locking plate 35 may, according one embodiment of the invention, be made in one piece constituting the tension bar. This will, however, limit the flexibility of the invention, as both the applied tension and the shape of the hollow or recess 30 may be chosen in a great variety of ways with the preferred solution.

The physical size of the interchangeable cassette may vary within the practical limits of a putter head, and the band length. A typical circumference of the band may be in the range of 150–160 mm, the thickness and length of the cassette thus for example being in the range of 12–16 mm and 65–110 mm, respectively.

What is claimed is:

1. A golf putter head comprising:

an interchangeable part including a striking surface, said interchangeable part comprising:

band shaped material which comprises a loop, a portion of said band shape material comprising said striking surface; and a tension bar provided at least partially inside said band shaped material and adapted to impart a preselected and prefixed tension to said band shaped material thus providing a hard and rigid striking surface, said tension bar including protrusions on opposite sides of said striking surface thus defining a recess behind said band material at said striking surface; and holding means for receiving the interchangeable part and locking it into position on the putter head.

2. Golf putter according to claim 1, wherein the interchangeable part consists of a cassette with a fixed tension in the band shaped material.

3. Golf putter according to claim 1, wherein the tension bar is essentially shaped as a flat plate having said protrusions at the opposite sides of the plate, said protrusions extending perpendicular to the longitudinal direction of the plate, thus providing said recess between the protrusions and the plate.

4. Golf putter according to claim 3, wherein said protrusions are provided by end pieces interchangeably connected to the plate, thus providing for the selection of the tension applied on the band as well as the size of the recess, by changing the end pieces or the flat plate.

5. Golf putter according to claim 3, wherein the length of the tension bar is adjustable, thus providing for the selection of the tension applied on the band as well as the size of the recess.

6. Golf putter according to claim 1, wherein the putter head defines a hollow for receiving the interchangeable part, one side of said hollow being defined by a removable end plate provided with fastening means for fastening the removable end plate. to the putter head to thereby lock a received interchangeable part into said hollow.

7. Golf putter according to claim 1, wherein the band shaped material is made from metal.

8. Golf putter according to claim 1, wherein the band shaped material is made from a woven material with high tensile strength.

9. Golf putter according to claim 1, wherein the band shaped material is made of metal coated with a low friction material.

10. An interchangeable part for a putter head including a striking surface, said interchangeable part comprising:

band shaped material which constitutes a loop, a portion of said band shape material comprising said striking surface; and a tension bar provided at least partially inside said band shaped material and adapted to impart a preselected and prefixed tension to said band shaped material thus providing a hard and rigid striking surface, said tension bar including protrusions on opposite sides of said striking surface thus defining a recess behind said band material at said striking surface.

11. Golf putter part according to claim 10, wherein the tension bar is essentially shaped as a flat plate having said protrusions at the opposite sides of the plate, said protrusions extending perpendicular to the longitudinal direction of the plate, thus providing said recess between the protrusions and the plate.

12. Golf putter part according to claim 11, wherein said protrusions comprise end pieces interchangeably connected to the plate, thus providing for the selection of the tension applied on the band shaped material as well as the size of the recess, by changing the end pieces or the flat plate.

13. Golf putter part according to claim 12, wherein the end pieces extend toward each other in contact with the band shaped material, the edges of the end pieces defining the shape of the recess between the band shaped material and the tension bar.

14. Golf putter part according to claim 13, wherein, the edges define a geometrical shape.

15. Golf putter part according to claim 10, wherein the length of the tension bar is adjustable, thus providing for the selection of the tension applied on the band shaped material as well as the size of the recess.

16. Golf putter part according to claim 10, wherein the tension bar comprises at least one protrusion extending toward the band shaped material in the recess.

17. Golf putter part according to claim 10, wherein the tension bar includes at least one pin extending from opposite sides of the tension bar in the vicinity of the striking surface and defining a gap of a preselected size between an end of the pin and the band shaped material on each side of the tension bar.

18. Golf putter part according to claim 10, wherein the band thickness varies within predetermined limits over the striking surface.

* * * * *